US005822725A

United States Patent [19]

Komatsu et al.

[11] Patent Number: 5,822,725

[45] Date of Patent: Oct. 13, 1998

[54] VOX DISCRIMINATION DEVICE

[75] Inventors: Masahiro Komatsu; Takashi Shoji, both of Tokyo, Japan

[73] Assignee: NEC Corporation, Tokyo, Japan

[21] Appl. No.: 742,349

[22] Filed: Nov. 1, 1996

[30] Foreign Application Priority Data

Nov. 1, 1995 [JP] Japan ..... 7-284738

[51] Int. Cl.[6] ..... G10L 5/00

[52] U.S. Cl. ..... 704/226; 704/214

[58] Field of Search ..... 704/208, 214, 704/215, 216, 226

[56] References Cited

U.S. PATENT DOCUMENTS

| | | | |
|---|---|---|---|
| 5,012,519 | 4/1991 | Adlersberg et al. | 704/226 |
| 5,509,102 | 4/1996 | Sasaki | 704/219 |
| 5,596,608 | 1/1997 | Sassa et al. | 375/346 |

FOREIGN PATENT DOCUMENTS 3-286634 12/1991 Japan .

*Primary Examiner*—David R. Hudspeth
*Assistant Examiner*—Susan Wieland
*Attorney, Agent, or Firm*—Ostrolenk, Faber, Gerb & Soffen, LLP

[57] ABSTRACT

In a radio communication system such as a digital automobile telephone, a VOX controller stops a transmission of a frame having no voice data to perform power savings, and a VOX device discriminates whether the voice data are present or absent in each frame. In a reference power measuring circuit, all or selected pilot signals of a received frame are oppositely rotated using theoretical values of the pilot signals to uniform their phases, and in-phase vector synthesis is conducted. The vector synthesis result is averaged by the number of the synthesis symbols, and an absolute value of the averaged vector value becomes the desired signal reference power X. In a fading compensation circuit, by using the previous and next pilot signals of a data part, each fading vector is calculated. In a power measuring circuit, the data upon which the fading compensation has been conducted are oppositely rotated to uniform their phases, and in-phase vector synthesis is carried out. The vector synthesis result is averaged by the number of the synthesis symbols, and an absolute value of the averaged vector value become a received signal power Y. In a discrimination circuit, the desired signal reference power X and the received signal power Y are compared with each other to carry out a VOX discrimination.

9 Claims, 12 Drawing Sheets

FIG. 4

| | SYMBOLS | RECEIVED SIGNALS | THEORETICAL VALUES |
|---|---|---|---|
| PILOT SIGNAL 1 | 1 | $I_{1-1} + jG_{1-1}$ | $\hat{I}_{1-1} + j\hat{Q}_{1-1}$ |
| | 2 | $I_{1-2} + jG_{1-2}$ | $\hat{I}_{1-2} + j\hat{Q}_{1-2}$ |
| | 3 | $I_{1-3} + jG_{1-3}$ | $\hat{I}_{1-3} + j\hat{Q}_{1-3}$ |
| | 4 | $I_{1-4} + jG_{1-4}$ | $\hat{I}_{1-4} + j\hat{Q}_{1-4}$ |
| | 5 | $I_{1-5} + jG_{1-5}$ | $\hat{I}_{1-5} + j\hat{Q}_{1-5}$ |
| PILOT SIGNAL 2 | 1 | $I_{2-1} + jG_{2-1}$ | $\hat{I}_{2-1} + j\hat{Q}_{2-1}$ |
| | 2 | $I_{2-2} + jG_{2-2}$ | $\hat{I}_{2-2} + j\hat{Q}_{2-2}$ |
| | 3 | $I_{2-3} + jG_{2-3}$ | $\hat{I}_{2-3} + j\hat{Q}_{2-3}$ |
| | 4 | $I_{2-4} + jG_{2-4}$ | $\hat{I}_{2-4} + j\hat{Q}_{2-4}$ |
| | 5 | $I_{2-5} + jG_{2-5}$ | $\hat{I}_{2-5} + j\hat{Q}_{2-5}$ |
| PILOT SIGNAL 3 | 1 | $I_{3-1} + jG_{3-1}$ | $\hat{I}_{3-1} + j\hat{Q}_{3-1}$ |
| | 2 | $I_{3-2} + jG_{3-2}$ | $\hat{I}_{3-2} + j\hat{Q}_{3-2}$ |
| | 3 | $I_{3-3} + jG_{3-3}$ | $\hat{I}_{3-3} + j\hat{Q}_{3-3}$ |
| | 4 | $I_{3-4} + jG_{3-4}$ | $\hat{I}_{3-4} + j\hat{Q}_{3-4}$ |
| | 5 | $I_{3-5} + jG_{3-5}$ | $\hat{I}_{3-5} + j\hat{Q}_{3-5}$ |

FIG. 5

| TERMS | FORMULAS |
|---|---|
| 1 | $(Ik + jQk) \times (\hat{I}k - j\hat{Q}k)$ [k=1−1~3−5] |
| 2 | $\{\sum_k (Ik + jQk) \times (\hat{I}k - j\hat{Q}k)\}/15$ |
| 3 | $X = \left\lvert \{\sum_k (Ik + jQk) \times (\hat{I}k - j\hat{Q}k)\}/15 \right\rvert^2$ |

FIG. 6

| | | PILOT SIGNAL 1 | | | | | PILOT SIGNAL 2 | | | | | PILOT SIGNAL 3 | | | | |
|---|---|---|---|---|---|---|---|---|---|---|---|---|---|---|---|---|
| RECEIVED DATA | I | −0.81 | −0.91 | −1.33 | −1.19 | 0.71 | −1.05 | 0.77 | −0.53 | 0.94 | −0.77 | 1.30 | 1.03 | −1.36 | −1.08 | 1.10 |
| | Q | 1.32 | 0.79 | 0.88 | 0.78 | −1.30 | 0.50 | −1.04 | −0.69 | −1.06 | −0.50 | −0.81 | 0.72 | 0.88 | −1.00 | 1.20 |
| PL THEORETICAL VALUES | I | −1.0 | −1.0 | −1.0 | −1.0 | 1.0 | −1.0 | 1.0 | −1.0 | 1.0 | −1.0 | 1.0 | 1.0 | −1.0 | −1.0 | 1.0 |
| | Q | 1.0 | 1.0 | 1.0 | 1.0 | −1.0 | 1.0 | −1.0 | −1.0 | −1.0 | −1.0 | −1.0 | 1.0 | 1.0 | −1.0 | 1.0 |

FIG. 7

| | | |
|---|---|---|
| FADING VECTORS | $FV_1$ | $\frac{\sum_i (I_{1-i} + jQ_{1-i}) \times (\hat{I}_{1-i} - j\hat{Q}_{1-i})}{5} = 2.004 - j0.024$ |
| | $FV_2$ | $\frac{\sum_i (I_{2-i} + jQ_{2-i}) \times (\hat{I}_{2-i} - j\hat{Q}_{2-i})}{5} = 1.590 - j0.010$ |
| | $FV_3$ | $\frac{\sum_i (I_{3-i} + jQ_{3-i}) \times (\hat{I}_{3-i} - j\hat{Q}_{3-i})}{5} = 2.096 + j0.136$ |

[$i = 1 \sim 5$]

FIG. 8

| | RECEIVED DATA | | FADING VECTORS | | DATA AFTER CORRECTION | |
|---|---|---|---|---|---|---|
| | I | Q | I | Q | I | Q |
| 6 | −1.21 | 0.96 | 1.906 | −0.029 | −2.334 | 1.794 |
| 7 | 0.74 | −1.18 | 1.876 | −0.031 | 1.424 | −2.191 |
| 8 | −1.14 | 0.78 | 1.848 | −0.032 | −2.131 | 1.450 |
| 9 | −0.84 | −1.15 | 1.821 | −0.033 | −1.492 | −2.121 |
| 10 | 0.88 | −0.91 | 1.795 | −0.033 | 1.610 | −1.604 |
| 11 | 0.85 | −0.91 | 1.771 | −0.034 | 1.537 | −1.583 |
| 12 | 1.12 | 0.86 | 1.749 | −0.034 | 1.929 | 1.542 |
| 13 | −1.02 | 0.71 | 1.728 | −0.034 | −1.787 | 1.192 |
| 14 | 1.20 | −0.79 | 1.708 | −0.034 | 2.077 | −1.309 |
| 15 | −0.96 | 1.23 | 1.690 | −0.034 | −1.664 | 2.047 |
| 16 | −0.87 | 0.83 | 1.674 | −0.033 | −1.484 | 1.360 |
| 17 | 1.11 | 1.09 | 1.659 | −0.032 | 1.806 | 1.844 |
| 18 | −1.15 | −0.94 | 1.645 | −0.031 | −1.862 | −1.583 |
| 19 | −0.93 | 1.12 | 1.633 | −0.030 | −1.553 | 1.801 |
| 20 | 1.00 | −0.96 | 1.622 | −0.029 | 1.650 | −1.529 |
| 21 | 0.97 | 0.92 | 1.613 | −0.027 | 1.540 | 1.511 |
| 22 | −1.06 | 0.92 | 1.605 | −0.025 | −1.725 | 1.450 |
| 23 | −0.80 | 0.80 | 1.599 | −0.023 | −1.298 | 1.261 |
| 24 | 0.78 | −0.94 | 1.594 | −0.021 | 1.263 | −1.482 |
| 25 | −0.78 | 0.85 | 1.591 | −0.019 | −1.257 | 1.338 |

FIG. 9A

| RECEIVED DATA | DISCRIMINATION DATA $\hat{I}(x) + j\hat{Q}(x)$ |
|---|---|
| $I'(x) + jQ'(x)$ | $\hat{I}(x) = \begin{cases} 1 & I'(x) \geq 0 \\ -1 & I'(x) < 0 \end{cases}$ <br> $\hat{Q}(x) = \begin{cases} 1 & Q'(x) \geq 0 \\ -1 & Q(x) < 0 \end{cases}$ |

FIG. 9B $\Downarrow$

| IN-PHASE AVERAGING |
|---|
| $\dfrac{\sum_x (I'(x) - jQ'(x)) \times (\hat{I}(x) - j\hat{Q}(x))}{20}$ |

FIG. 9C $\Downarrow$

| RECEIVED SIGNAL POWER $Y_1$ |
|---|
| $Y_1 = \left\lvert \dfrac{\sum_x (I'(x) + jQ'(x)) \times (\hat{I}(x) - j\hat{Q}(x))}{20} \right\rvert$ |

VOX DISCRIMINATION DEVICE

BACKGROUND OF THE INVENTION

The present invention relates to a VOX (voice operated transmission) discrimination device, and more particularly to a VOX device for discriminating whether voice data are present or absent in each received frame in digital automobile telephone radio communication system.

In a radio communication system such as a digital automobile telephone, in order to reduce consumption power for attaining power saving of the system in transmitting and to reduce interference between multiple users for ensuring communication capacity, a VOX control is used to carry out a transmission only when voice data are present and to stop the transmission when no voice data are present. In order to perform such a VOX function, whether the voice data are present or absent is discriminated in the receiving side, and it is necessary to conduct a voice decoding when the voice is present and to implement a voiceless outputting as a noise signal in a signal section including no voice data.

FIG. 1 shows one example of transmission data of a conventional transmitter having a VOX device. More specifically, FIG. 1*a* shows voiced (with a voice) and unvoiced (voiceless) frames, and FIG. 1*b* shows a transmitting state of these frames. One frame consists of four slots. The head of the frame, the first slot contains frame control data, in which a VOX bit is included as a special pattern for showing whether the frame is a VOX or a non-VOX.

In a non-VOX frame (a voiced frame), the voice data are transmitted in the second to fourth slots. In a VOX frame (as an unvoiced frame), only pilot signals (PLs) are transmitted in the second to fourth slots in their pilot signal parts, and the transmission is stopped in the other parts known as data parts.

Next, an operation on the receiving side of the conventional VOX discrimination controller when carrying out such a VOX will be described with reference to FIG. 2.

In FIG. 2, frame receiving is conducted in step 61, and a VOX bit included in frame control data is discriminated in step 62. When the discrimination result is "VOX", a voiceless outputting is carried out in step 63. On the other hand, when the discrimination result is "non-VOX", a voice decoding is performed in step 64.

As described above, when the VOX bit is incorrectly detected and discriminated, the voiceless outputting is executed in the unvoiced section, and the voice decoding is implemented in the voiced section, thereby outputting the voice without any trouble. One example of this kind of technique is disclosed in Japanese Patent Application Laid-Open Publication No. 3-286634.

However, when an erroneous discrimination of the VOX bit is conducted by distortion of a voiceless transmission path, interference between multiple users, or the like, the VOX controller malfunctions and fails to disable or enable voice outputting. That is, although voice data are transmitted, the discrimination of the VOX bit results in "VOX" in the VOX controller, and a voiceless outputting is erroneously carried out in the received frame.

SUMMARY OF THE INVENTION

Accordingly, it is an object of the present invention to provide a VOX discrimination device in view of the above described problems of the prior art, which is capable of detecting whether voice data are present or absent in each frame correctly to prevent trouble caused by an erroneous discrimination of a VOX bit.

In accordance with one aspect of the present invention, there is provided a voice operated transmission discrimination device for discriminating whether voice data are present or absent in each received frame in a received signal in which each frame in the received signal includes a plurality of time slots, and each time slot has a pilot signal for synchronism control in a header portion, comprising reference power measuring means for measuring an average power of predetermined pilot signals within the received frame to output a reference power; average power measuring means for measuring an average power of predetermined time slots for voice data within the received frame; and comparison discrimination means for comparing the reference power output from the reference power measuring means with the average power of the average power measuring means to discriminate whether the voice data are present or absent in the received frame.

In a voice operated transmission discrimination device, preferably, the average power measuring means includes fading compensation means for carrying out fading compensation of data of the time slot for the voice data; and measuring means for measuring an average power of data of the time slot for the voice data after the fading compensation.

In accordance with another aspect of the present invention, there is provided a voice operated transmission discrimination device for discriminating whether voice data are present or absent in each received frame in a received signal in which each frame in the received signal includes a plurality of time slots, and each time slot has a pilot signal for synchronism control in a header portion, comprising reference power measuring means for measuring an average power of predetermined pilot signals within the received frame to output a reference power; fading compensation means for carrying out fading compensation of data of a time slot for frame control data and of data for a predetermined time slot for voice data within the received frame; first average power measuring means for measuring a first average power of the data of the time slot for the frame control data after the fading compensation; second average power measuring means for measuring a second average power of the data of the predetermined time slot for the voice data after the fading compensation; and comparison discrimination means for comparing an absolute value of a difference between the reference power and the first average power of the first average power measuring means with an absolute value of a difference between the reference power and the second average power of the second average power measuring means to discriminate whether the voice data are present or absent in the received frame.

According to the present invention, regarding at least a part of the pilot signals of one frame of the received data, phase processing is conducted, and an in-phase vector synthesis is carried out. This result is averaged by the number of the synthesis symbols, and an absolute value of the averaged vector value becomes the desired signal reference power X. An average received signal power Y of the data part of the time slot for the voice data except its pilot part is calculated. The desired signal reference power X and the average received signal power Y are compared with each other to discriminate whether the voice data are present or absent in the received frame.

In order to remove the influence of fading, by using the previous and next pilot signals of the time slot for the voice data, fading compensation of its voice data part is carried out, and an average received signal power Y of the voice data part after the fading compensation is calculated. The desired signal reference power X and the average received signal power Y are compared with each other to discriminate whether the voice data are present or absent in the received frame. As a result, a correct discrimination result without any influence of fading can be obtained.

BRIEF DESCRIPTION OF THE DRAWINGS

The objects, features and advantages of the present invention will become more apparent from the consideration of the following detailed description, taken in conjunction with the accompanying drawings, in which:

FIG. 4 is a schematic diagram showing received signals of symbols of pilot signals and the theoretical values corresponding to the received signals in the present invention;

FIG. 5 is a schematic diagram showing a measuring method of a reference power measuring circuit shown in FIG. 3;

FIG. 6 is a schematic diagram showing one example of relationship between received data of pilot signals and the theoretical values corresponding to the received data in the present invention;

FIG. 7 is a schematic diagram showing an expression example of fading vectors in the present invention;

FIG. 8 is a schematic diagram showing examples relationship between received data and data obtained by fading correction in the present invention;

FIG. 9(A), FIG. 9(B) and FIG. 9(C) are schematic diagrams showing a measuring method of a power measuring circuit shown in FIG. 3;

DESCRIPTION OF THE PREFERRED EMBODIMENTS

Figure 3:
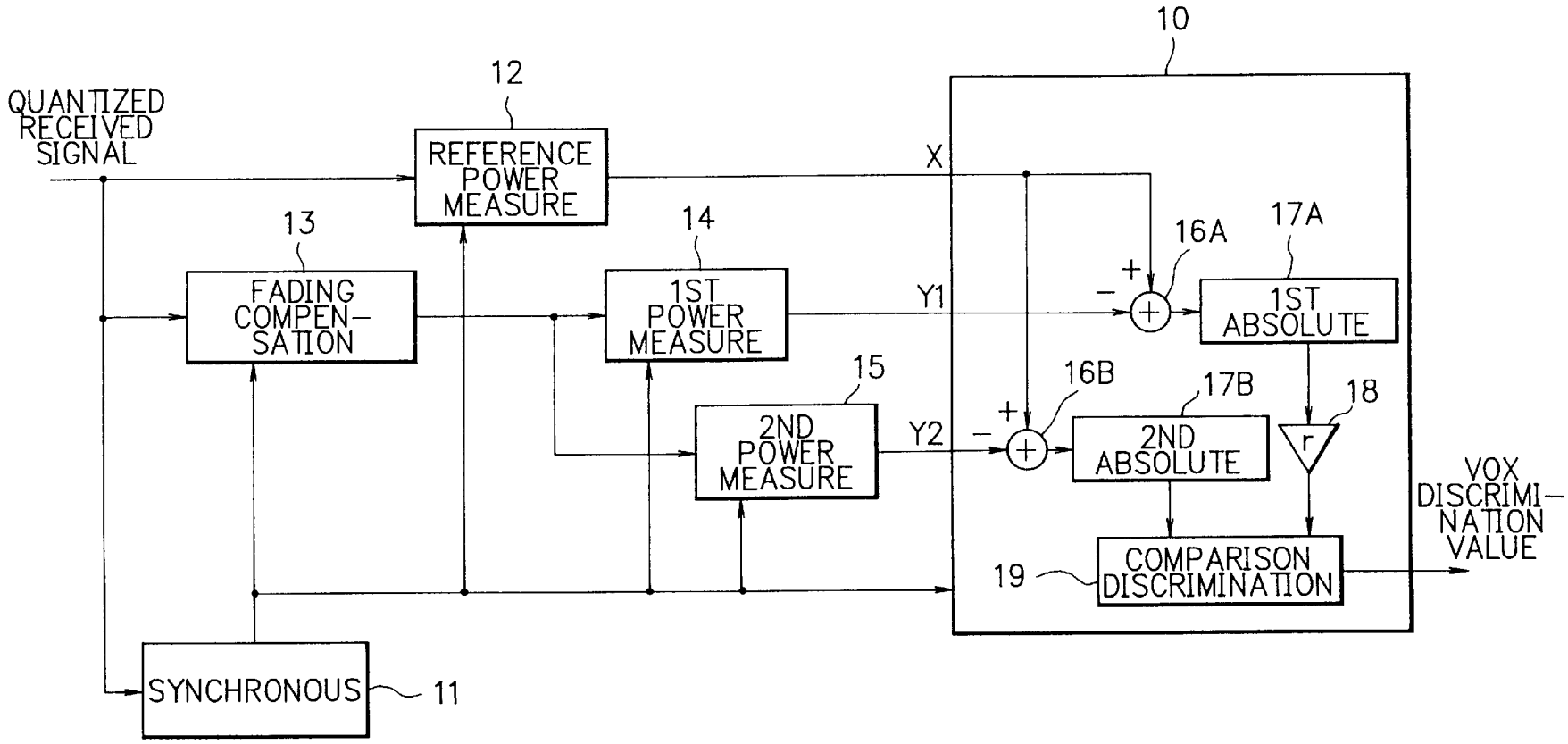
FIG. 3 is a circuit diagram of a VOX discrimination device according to one embodiment of the present invention.

Referring now to the drawings, in FIG. 3, there is shown a VOX discrimination device according to one embodiment of the present invention.

In FIG. 3, a received signal is input to a reference signal measuring circuit 12. The reference signal measuring circuit 12 measures an average power of pilot signals (all or a part) predetermined in each received frame and outputs as the desired signal reference power X.

Figure 1:
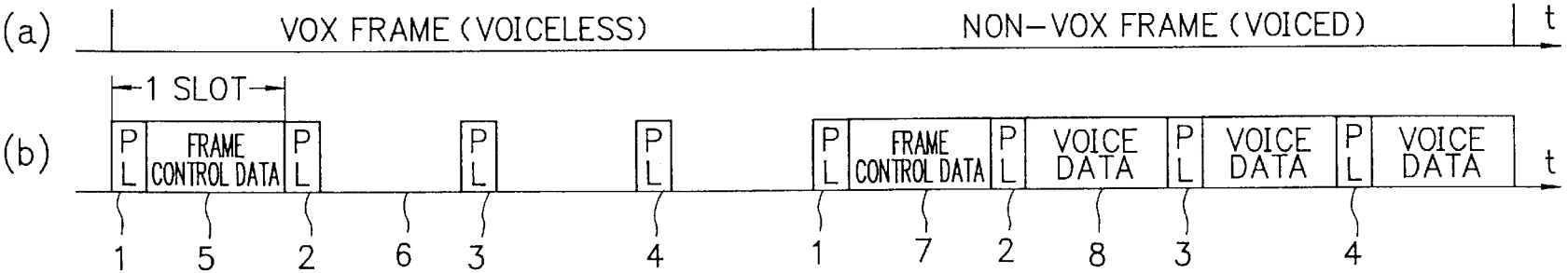
FIG. 1 PRIOR ART
FIG. 1 is a schematic diagram showing a transmission frame format of a conventional transmitter having a VOX device.
Figure 2:
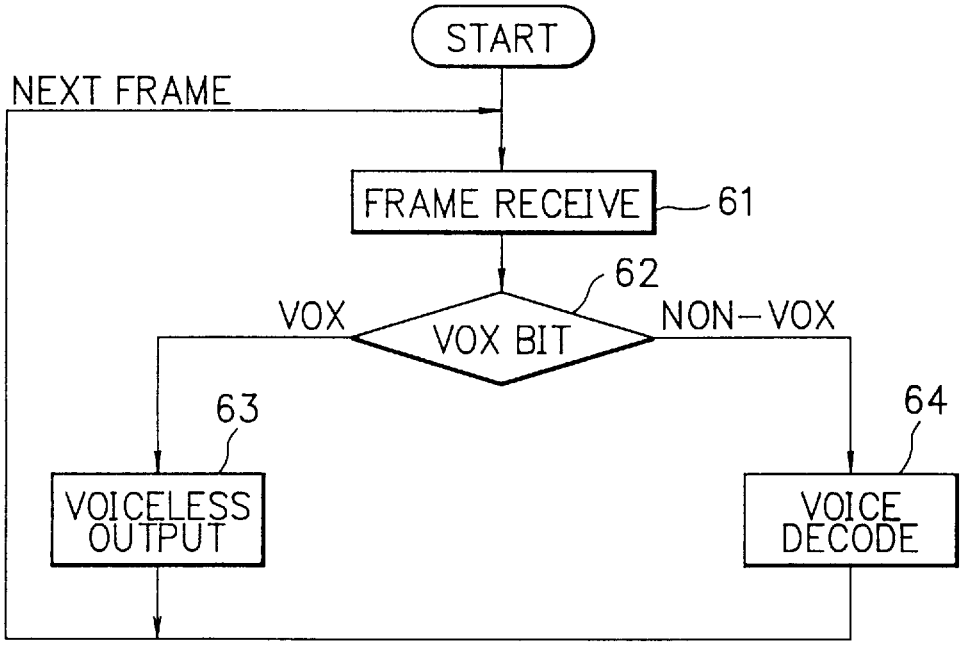
FIG. 2 PRIOR ART
FIG. 2 is a flow chart showing an operation of a conventional VOX controller.

The received signal is also input to a synchronous circuit 11 and to a fading compensation circuit 13. The fading compensation circuit 13 functions so as to remove the influence of fading when average powers of time slots 5 and 7 (the first slots) (see FIG. 1) for frame control data and of time slots 6 and 8 (the second slots) (see FIG. 1) for voice data are measured in first and second power measuring circuits 14 and 15, respectively, at the following stage.

After the fading compensation is completed, the received signal is input to the first and second power measuring circuits 14 and 15 which measure first and second average powers Y1 and Y2 of the time slots 5 and 7 for the frame control data and of the time slots 6 and 8 for the voice data, respectively.

The desired signal reference power X and the first and second average powers Y1 and Y2 are fed to a discrimination circuit 10 for carrying out VOX discrimination. In the discrimination circuit 10, a difference between the desired signal reference power X and the first average power Y1 is calculated in a first adder 16A, and its absolute value is obtained in a first absolute value circuit 17A. A difference between the desired signal reference power X and the second average power Y2 is calculated in a second adder 16B, and its absolute value is obtained in a second absolute value circuit 17B.

The absolute value of the first absolute value circuit 17A is multiplied by a factor $\gamma$ in a gain circuit 18, and the multiplied result of the gain circuit 18 and the absolute value of the second absolute value circuit 17B are compared with each other in a comparison discrimination circuit 19 to perform the VOX discrimination.

The synchronous circuit 11 detects frame synchronism using the pilot signals included in the received signal and produces timing signals for operating instructions of the elements 10 and 12 to 15.

The operation of the above described VOX discrimination device shown in FIG. 3 will be described. A frame signal as an input is a digital sampling signal with a symbol rate primarily demodulated by a CDMA (code division multiple access) receiver, and it is assumed that its frame format is that shown in FIG. 1.

In the reference power measuring circuit 12, complex conjugates of the theoretical values of pilot signals 1, 2 and 3 are multiplied to respective symbols of the received signals so as to uniform the phases of the symbols, and their in-phase vector synthesis is implemented. The vector synthesis result is averaged by the number of the synthesis symbols of the pilot signals. A square value of the absolute value (norm) of the averaged vector value becomes the desired signal reference power X which is output to the discrimination circuit 10.

The description will be further detailed with reference to specific examples. For example, assuming that a received signal is a voice PCM (pulse code modulation) signal modulated with a QPSK (quadraphase shift keying), each symbol (corresponding to one sample data) of the pilot signal is expressed by a complex vector which is generally represented by (I+jQ).

In this embodiment, it is assumed that an average power of three pilot signals 1 to 3 within one frame is determined as a reference power and each pilot signal includes five symbols. The received signals of the pilot signals 1 to 3 can be expressed as complex numbers in the left column "Received signals" in FIG. 4 which also includes the complex "theoretical values" of these signals in the right column.

In order to calculate an average power of such pilot signals 1 to 3, first, it is necessary to uniform the phases of the symbols. The complex conjugates of the received signals are required to be multiplied to their symbols, respectively. That is, with a calculation according to a formula shown in term 1 in FIG. 5, the phases can be uniformed in all the symbols.

Such multiplied results are averaged according to a formula shown in term 2 in FIG. 5, and a square value of the absolute value of the averaged result is calculated according to a formula shown in term 3 in FIG. 5 to obtain the desired signal reference power X.

For example, in one case with received data and pilot theoretical values shown in FIG. 6, the desired signal reference value X is calculated as follows:

$$X=|1.897+j0.034|^2=3.599$$

In the fading compensation circuit 13, the complex conjugates of the theoretical values of each pilot signal are multiplied to the respective symbols of the received signals so as to uniform the phases of the symbols, and their in-phase vector synthesis is carried out. The vector synthesis result is averaged by the number of the synthesis symbols to obtain an averaged pilot signal as a fading vector. In this way, three fading vectors FV1, FV2 and FV3 are obtained. A secondary interpolation using the first to third fading vectors FV1 to FV3 is conducted to prepare fading vectors of the data parts. The data part 5 or 7 of the first slot (except the pilot part 1) and the data part 6 or 8 of the second slot (except the pilot part 1) are multiplied by the conjugate complex numbers of the fading vectors to perform the data compensation.

More specifically, the first to third fading vectors FV1 to FV3 of the pilot signals 1 to 3 are expressed by formulas shown in FIG. 7 and can be calculated using the numeric values shown in FIG. 6 as follows:

$$FV1=2.004-j0.024$$

$$FV2=1.590-j0.010$$

$$FV3=2.096-j0.136$$

Now, for example, it is assumed that frame control data and voice data each have 20 symbols. Assuming that the head of a VOX frame (or a non-VOX frame) is determined as the first symbol, the third symbol (the third symbol as the central symbol of the pilot signal 1) has a first fading vector FV1, the 28th symbol (the third symbol as the central symbol of the pilot signal 2) has a second fading vector FV2, and the 53th symbol (the third symbol as the central symbol of the pilot signal 3) has a third fading vector FV3. Fading vectors of the other x-th symbols can be calculated by the secondary interpolation using the three fading vectors FV1 to FV3 as follows:

$$\begin{aligned}
FV(x) &= ax^2 + bx + c \\
a &= \{3(FV2-FV3) + 28(FV3-FV1) + 53(FV1-FV2)\} / (3-28)(28-53)(53-3) \\
&= 0.000736 + j0.000106 \\
b &= \{3^2(FV2-FV3) + 28^2(FV3-FV1) + 53^2(FV1-FV2)\} / (3-28)(28-53)(53-3) \\
&= -0.03938 - j0.002714 \\
c &= \{28x53(53-28)FV1 + 53x3(3-53)FV2 + 3x28(28-3)FV3\} /(3-28)(28-53)(53-3) \\
&= 2.116 - j0.01681
\end{aligned}$$

With the use of the fading vectors, the fading compensation is carried out in the data of the data part 5 (in the case of VOX frame) or 7 (in the case of non-VOX frame) of the first slot except the pilot signal 1 and the data part 6 (in the case of VOX frame) or 8 (in the case of non-VOX frame) of the second slot except the pilot signal 2.

Specifically, assuming that the x-th symbol of the frame is determined to I(x)+jQ(x) and the data after a fading correction is I'(x)+jQ'(x), a calculation of an equation I'(x) +jQ'(x)=((x)+jQ(x))FV * (x) is carried out against x=6, 7, 8, . . . , 24, 25, 31, 33, . . . , 49 and 50, wherein FV * (x) represents a complex conjugate of FV(x).

FIG. 8 shows specific examples of the received data and the data after the fading correction.

In the first power measuring circuit 14, a first received signal power Y1 is obtained using the data on which the fading compensation has been executed in the data part 5 or 7 of the first slot (except the pilot part 1). Specifically, after the fading compensation, the received data oppositely rotated using a discrimination value to uniform their phases, and their in-phase vector synthesis is conducted. This vector synthesis result is averaged by the number of the synthesis symbols, and an absolute value of the averaged vector value is calculated to obtain the first received signal power Y1 which is output to the discrimination circuit 10.

More specifically, in order to calculate the first received signal power Y1 using the fading compensation data of the data part 5 (in the case of VOX frame) or 7 (in the case of non-VOX frame) of the first slot except the pilot signal 1, first, the received data and the discrimination data (discrimination values 1 and −1) for discriminating the received data after the fading compensation are determined, as shown in the left and right columns, respectively, in FIG. 9A.

Thereafter, in order to uniform the phases of the received data by carrying out their opposite rotation using the discrimination values, it is necessary to multiply the received data (after the fading compensation) by the complex conjugates of the discrimination data, to carry out an in-phase vector addition of the multiplied values, and to average the addition result by the number of the symbols according to a formula shown in FIG. 9B.

An absolute value of such an averaged in-phase vector addition value is calculated to obtain the first received signal power Y1, as expressed by a formula shown in FIG. 9C. With the use of the specific example shown in FIG. 8, the first received signal power Y1 is obtained as follows:

$$Y1=|3.269+j0.071|=3.269$$

Similarly, in the second power measuring circuit 15, a second received signal power Y2 is calculated using the data of which the fading compensation is conducted in the data part 6 or 8 of the second slot except the pilot part 2. The second received signal power Y2 is also output to the discrimination circuit 10.

In the discrimination circuit 10, by using the desired signal reference power X and the first and second received signal powers Y1 and Y2, a comparison between X−Y2 and X−Y1 is implemented as follows. That is, the first and second adders 16A and 16B calculate X−Y1 and X−Y2, respectively, and the first and second absolute circuits 17A and 17B calculate the first and second absolute values, respectively. The first absolute value of the first absolute value circuit 17A is multiplied by the predetermined factor γ (>1. 0) in the gain circuit 18. In the comparison discrimination circuit 19, the multiplied result of the gain circuit 18 and the second absolute value of the second absolute value circuit 17B are compared with each other to perform the VOX discrimination as follows:

When $|X-Y2|>\gamma|X-Y1|$, the discrimination result is "VOX".

When $|X-Y2|\leq\gamma|X-Y1|$, the discrimination result is "non-VOX".

The reason of such discrimination results is as follows. That is, in the non-VOX frame, Y1 and X are nearly equal and their values are nearly zero. On the other hand, in the VOX frame, there is no transmission data in the data part 6, and Y2 is nearly zero. Hence, |X−Y2| is nearly equal to X, and |X−Y1| becomes nearly zero. In other words, regardless of VOX or non-VOX, |X−Y1| is always nearly zero. However, |X−Y2| is nearly equal to X in the VOX frame or is nearly zero in the non-VOX frame.

In the optimum case having no noise, no transmission distortion and no interference, the discrimination result is as follows:

$$|X-Y1|=0$$

$$|X-Y2|=X(VOX), \text{ or } 0\ (non\text{-}VOX)$$

A threshold value is suitably determined using the factor $\gamma$ to discriminate either VOX or non-VOX. This discrimination result is supplied to a voice processing circuit (not shown) at the following stage, and either a voiceless outputting or a voice decoding is carried out according to the discrimination result.

Figure 10:
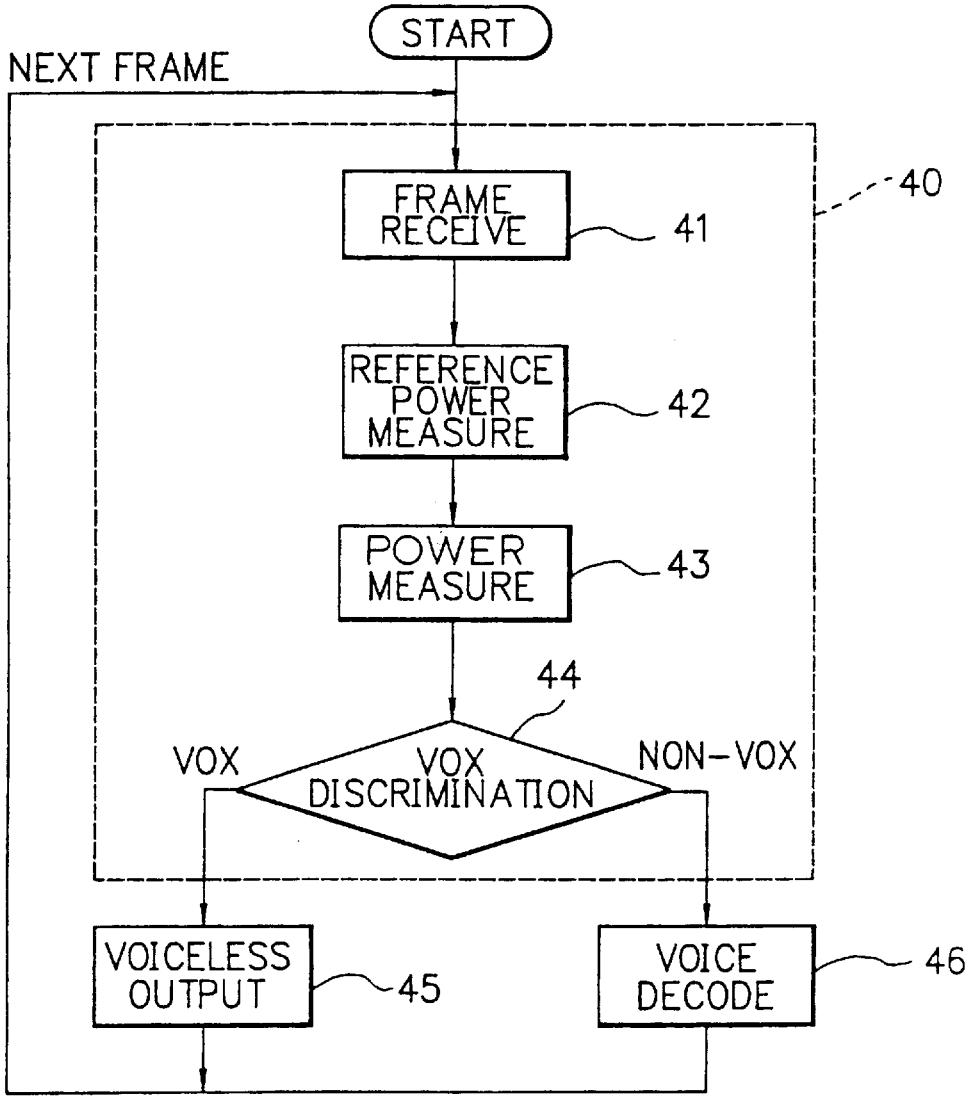
FIG. 10 is a flow chart showing an operation of a VOX discrimination device according one embodiment of the present invention.

FIG. 10 schematically shows the operation of the above described VOX discrimination device 40 of the present invention. First, in step 41, one frame of data are received.

In step 42, all or a part of the pilot signals 1 to 4 in the received frame is oppositely rotated by the theoretical values of the pilot signals to uniform their phases, and their in-phase vector synthesis is conducted. The vector synthesis result is averaged by the number of the synthesis symbols. An absolute value of the averaged vector value is calculated to obtain the desired signal reference power X.

In step 43, a received signal power Y is calculated using the data part 5 or 7 of the first slot and the data part 6 or 8 of the second slot except their pilot parts or the data part 6 or 8 of the second slot except its pilot part.

Specifically, the received signals are oppositely rotated by the theoretical values of the received signals of each pilot signal to uniform their phases, and their in-phase vector synthesis is conducted. The vector synthesis result is averaged by the number of the synthesis symbols. An absolute value of the averaged vector value is calculated. The fading compensation can be also carried out using the previous and next pilot signals.

In step 44, the desired signal reference power X and the received signal power Y are compared with each other to discriminate either "VOX" or "non-VOX". When the discrimination result is "VOX", the voiceless outputting is conducted in step 45. When the discrimination result is "non-VOX", the voice decoding is carried out in step 46.

Figure 11:
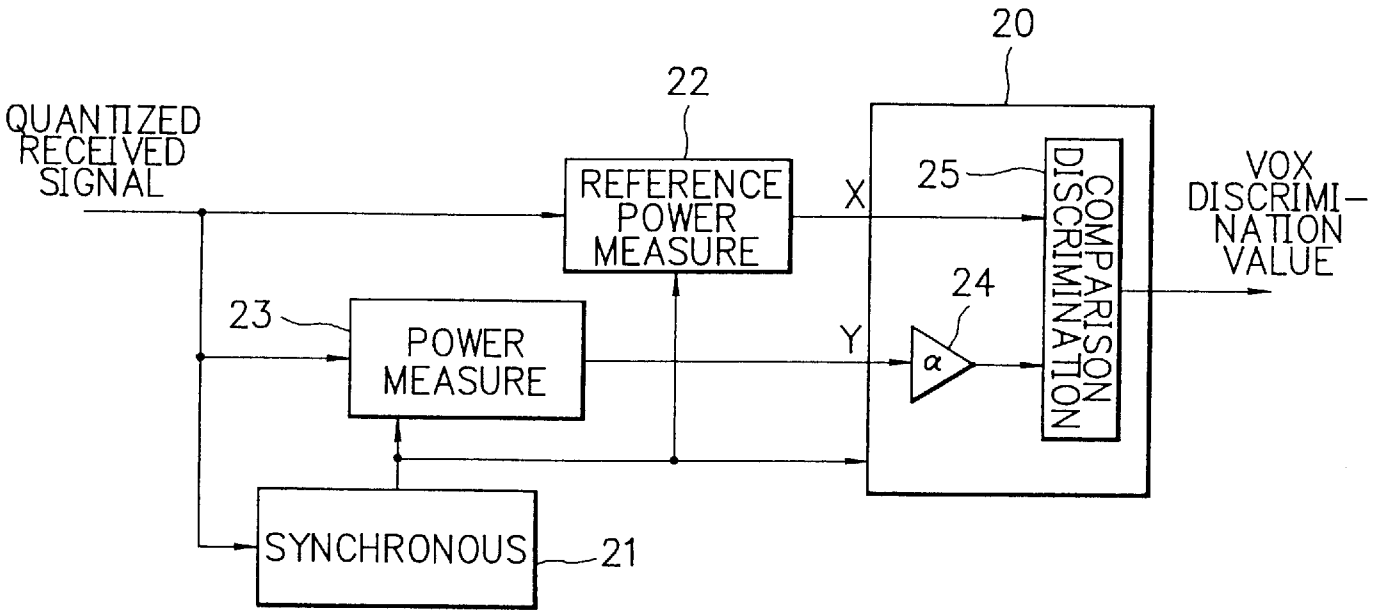
FIG. 11 is a circuit diagram of a VOX discrimination device according to another embodiment of the present invention.

FIG. 11 shows a VOX discrimination device according to another embodiment of the present invention. As shown in FIG. 11, the VOX discrimination device comprises a synchronous circuit 21 which receives a signal transmitted from a transmitter and outputs a synchronous signal for synchronizing the other parts, and a reference power measuring circuit 22, a power measuring circuit 23 and a discrimination circuit 20 which operate in synchronism with the synchronous signal output from the synchronous circuit 21. The reference power measuring circuit 22 and the power measuring circuit 23 calculate electric powers from the received signal to output the desired signal reference power X and the received signal power Y, respectively. The discrimination circuit 20 carries out a VOX discrimination using the desired signal reference power X and the received signal power Y to output a discrimination result "VOX" or "non-VOX".

The operation of this VOX discrimination device shown in FIG. 11 will be described. A frame signal as an input is a digital sampling signal with a symbol rate primarily demodulated by the CDMA receiver, and it is assumed that its frame format is that shown in FIG. 1. The synchronous circuit 21 detects a frame synchronism using the pilot signal included in the input signal to output the synchronous signal.

In the reference power measuring circuit 22, complex conjugates of theoretical values of a pilot signal 2 are multiplied to respective symbols of received signals so as to uniform the phases of the symbols, and their in-phase vector synthesis is carried out. The vector synthesis result is averaged by the number of the synthesis symbols of the pilot signals. A square value of the absolute value of the averaged vector value is calculated to obtain the desired signal reference power X which is output to the discrimination circuit 20.

In the power measuring circuit 23, the received signal power Y is calculated using the data part 6 or 8 of the second slot (except its pilot part 2). Specifically, in the same manner as described above in the operation of the power measuring circuit 14, the received data are oppositely rotated using a discrimination value to uniform their phases, and their in-phase vector synthesis is conducted. This vector synthesis result is averaged by the number of the synthesis symbols. An absolute value of the averaged vector value is calculated to obtain the received signal power Y which is output to the discrimination circuit 20.

In the discrimination circuit 20, by using the desired signal reference power X and the received signal power Y, a comparison between X and Y is carried out. In the gain circuit 24, a predetermined factor $\alpha(>1.0)$ is multiplied to the received signal power Y, and in the comparison discrimination circuit 25, the desired signal reference power X and the multiplied result of the gain circuit 24 are compared with each other to carry out the VOX discrimination as follows:

When $X \geqq \alpha Y$, the discrimination result is "VOX".

When $X < \alpha Y$, the discrimination result is "non-VOX".

This discrimination result is supplied to a voice processing circuit (not shown) at the following stage, and either a voiceless outputting or a voice decoding is carried out according to the discrimination result.

Figure 12:
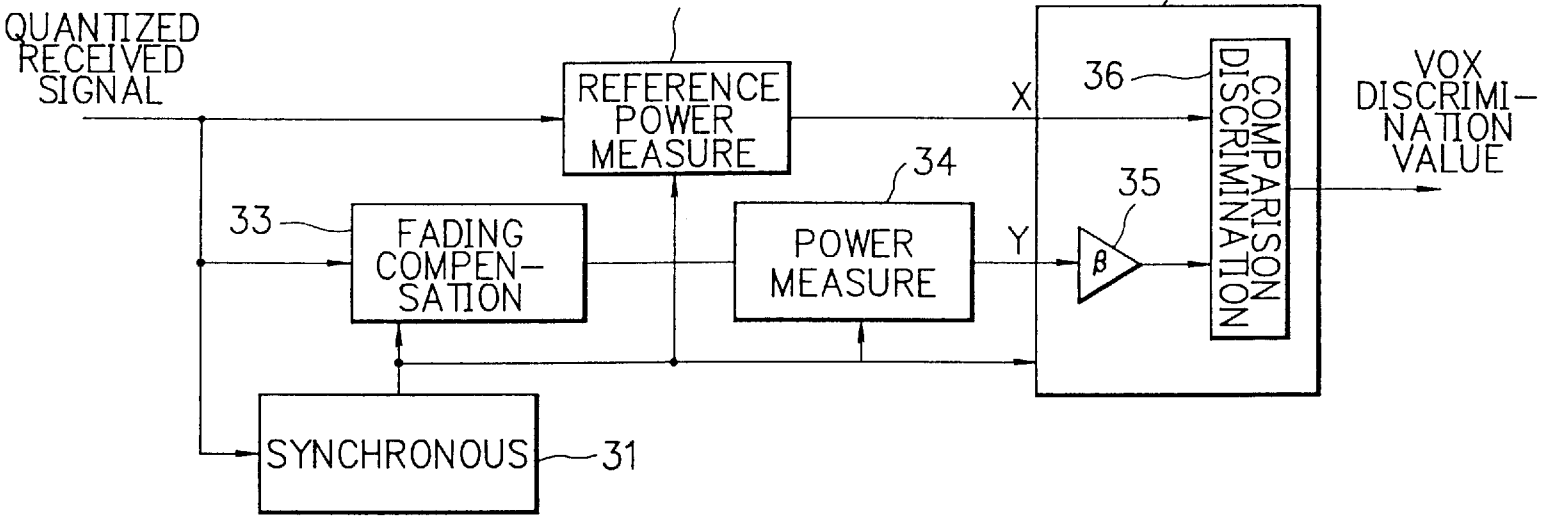
FIG. 12 is a circuit diagram of a VOX discrimination device according to a further embodiment of the present invention.

FIG. 12 shows a VOX discrimination device according to a further embodiment of the present invention. As shown in FIG. 12, the VOX discrimination device comprises a synchronous circuit 31 which receives a signal transmitted from a transmitter and outputs a synchronous signal for synchronizing the other parts, and a reference power measuring circuit 32, a fading compensation circuit 33, a power measuring circuit 34 and a discrimination circuit 30 which operate in synchronism with the synchronous signal output from the synchronous circuit 31.

The reference power measuring circuit 32 calculates the desired signal reference power X using the received signals, and the fading compensation circuit 33 performs the data compensation using the received signals. The power measuring circuit 34 calculates the received signal power Y using the signals upon which the fading compensation has been carried out in the fading compensation circuit 33. The discrimination circuit 30 carries out a VOX discrimination using the desired signal reference power X and the received signal power Y to output a discrimination result "VOX" or "non-VOX".

The operation of this VOX discrimination device shown in FIG. 11 will be described. A frame signal as an input is a digital sampling signal with a symbol rate primarily demodulated by the CDMA receiver, and it is assumed that its frame format is that shown in FIG. 1. The synchronous circuit 31 detects a frame synchronism using the pilot signal included in the input signal to output the synchronous signal.

In the reference power measuring circuit 32, complex conjugates of theoretical values of pilot signals 2 and 3 are multiplied to respective symbols of received signals so as to uniform the phases of the symbols, and their in-phase vector synthesis is carried out. The vector synthesis result is averaged by the number of the synthesis symbols of the pilot signals. A square value of the absolute value of the averaged vector value is calculated to obtain the desired signal reference power X which is output to the discrimination circuit 30.

In the fading compensation circuit 33, the complex conjugates of the theoretical values of each pilot signal 2 or 3 are multiplied to the respective symbols of the received signals so as to uniform the phases of the symbols, and their in-phase vector synthesis is carried out. The vector synthesis result is averaged by the number of the synthesis symbols to obtain an averaged pilot signal as a fading vector.

In this way, two fading vectors FV1 and FV2 are obtained. A secondary interpolation using the first and second fading vectors FV1 and FV2 is conducted to prepare fading vectors of the data parts. The data part 6 or 8 of the second slot (except the pilot part 2) are multiplied by the conjugate complex numbers of the fading vectors to perform the data compensation.

In the power measuring circuit 34, the received signal power Y is calculated using the data upon which the fading compensation has been carried out. Specifically, the received data are oppositely rotated using a discrimination value to uniform their phases, and their in-phase vector synthesis is conducted. This vector synthesis result is averaged by the number of the synthesis symbols. An absolute value of the averaged vector value is calculated to obtain the received signal power Y which is output to the discrimination circuit 30.

In the discrimination circuit 30, by using the desired signal reference power X and the received signal power Y, a comparison between X and Y is carried out. In the gain circuit 35, a predetermined factor $\beta(>1.0)$ is multiplied to the received signal power Y, and in the comparison discrimination circuit 36, the desired signal reference power X and the multiplied result of the gain circuit 35 are compared with each other to carry out the VOX discrimination as follows:

When $X \geqq \beta Y$, the discrimination result is "VOX".

When $X < \beta Y$, the discrimination result is "non-VOX".

This discrimination result is supplied to a voice processing circuit (not shown) at the following stage, and either a voiceless outputting or a voice decoding is carried out according to the discrimination result.

According to the present invention, as described above, the discrimination is carried out not simply by the power components of the received signals but by the ratio $(\alpha, \beta, \gamma)$ between the desired signal reference power X and the received signal power Y, and the precise VOX discrimination can be conducted. In particular, in combination with the use of the information bit for the discrimination, the detection performance of the VOX can be improved.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A voice operated transmission discrimination device for discriminating whether voice data are present or absent in a received frame in a received signal in which the frame includes a plurality of time slots, and each time slot has a pilot signal for synchronism control in a header portion, the device comprising:

reference power measuring means for measuring an average power of predetermined pilot signals within the received frame and for outputting a reference power;

average power measuring means for measuring an average power of predetermined time slots for voice data within the received frame and for outputting the average power; and comparison discrimination means for comparing the reference power output from the reference power measuring means with the average power of the average power measuring means to discriminate whether the voice data are present or absent in the received frame.

2. A voice operated transmission discrimination device of claim 1, wherein the average power measuring means includes:

fading compensation means for carrying out fading compensation of data of the time slot for the voice data; and measuring means for measuring an average power of data of the time slot for the voice data after the fading compensation.

3. A voice operated transmission discrimination device of claim 1, wherein the fading compensation means executes an in-phase vector synthesis by an in-phase processing of the predetermined pilot signals, executes an averaging after the in-phase vector synthesis to calculate a fading vector of each pilot signal, executes a secondary interpolation using the fading vectors to calculate fading vectors of data, and executes the compensation of the data of the time slot for the frame control data and of the data of the time slot for the voice data using the fading vectors of the data after the secondary interpolation.

4. A voice operated transmission discrimination device of claim 1, wherein the reference power measuring means measures the reference power by an in-phase averaging of the predetermined pilot signals.

5. A voice operated transmission discrimination device of claim 1, wherein the average power measuring means measures the average power by an in-phase averaging of the data of the input time slot.

6. A voice operated transmission discrimination device for discriminating whether voice data are present or absent in a received frame in a received signal in which the frame includes a plurality of time slots, and each time slot has a pilot signals for synchronism control in a header portion, the device comprising;

reference power measuring means for measuring an average power of predetermined pilot signals within the received frame and for outputting a reference power;

fading compensation means for carrying out fading compensation of data of a time slot for frame control data and of data for a predetermined time slot for voice data within the received frame.

7. A voice operated transmission discrimination device of claim 6, wherein the average power measuring means measures the average power by an in-phase averaging of the data of the input time slot.

8. A voice operated transmission discrimination device of claim 6, wherein the reference power measuring means measures the reference power by an in-phase averaging of the predetermined pilot signals.

9. A voice operated transmission discrimination device of claim 6, wherein the fading compensation means executes an in-phase vector synthesis by an in-phase processing of the predetermined pilot signals, executes an averaging after the in-phase vector synthesis to calculate a fading vector of each pilot signal, executes a secondary interpolation using the fading vectors to calculate fading vectors of data, and executes the compensation of the data of the time slot for the frame control data and of the data of the time slot for the voice data using the fading vectors of the data after the secondary interpolation.

* * * * *